US006394228B1

(12) United States Patent
Stephens et al.

(10) Patent No.: US 6,394,228 B1
(45) Date of Patent: May 28, 2002

(54) ACCESSORY FOR A FENCE POST

(76) Inventors: Kendall M. Stephens, RR-1 Box 1434, Stella, MO (US) 64867; Norman D. Gideon, Rte. 3 Box 3422, Anderson, MO (US) 64831

( * ) Notice: Subject to any disclaimer, the term of this patent is extended or adjusted under 35 U.S.C. 154(b) by 0 days.

(21) Appl. No.: 09/627,469

(22) Filed: Jul. 28, 2000

(51) Int. Cl.[7] ..... E04G 3/00

(52) U.S. Cl. ..... 182/92; 182/119; 182/189; 182/190; 256/47; 256/54

(58) Field of Search ..... 182/90, 91, 92, 182/119, 123, 189, 43, 190; 256/32, 35, 47, 48, 52, 54; 248/297.51

(56) References Cited

U.S. PATENT DOCUMENTS

| | | | | | |
|---|---|---|---|---|---|
| 197,766 | A | | 12/1877 | Crawford | 182/119 |
| 480,977 | A | | 8/1892 | Thomas | 182/189 |
| 795,782 | A | * | 7/1905 | Porter | 403/211 X |
| 1,530,330 | A | * | 3/1925 | Rowe | 256/47 X |
| 1,613,716 | A | | 1/1927 | Mylaeus | 47/43 |
| 3,259,209 | A | | 7/1966 | Brown | 182/189 |
| 3,568,980 | A | * | 3/1971 | Hulburt | 256/10 |
| 3,817,351 | A | | 6/1974 | Mikkelson | 182/190 |
| 4,103,853 | A | * | 8/1978 | Bannan | 248/219.1 |
| 4,249,635 | A | | 2/1981 | West | 182/92 |
| 4,265,333 | A | | 5/1981 | Rowell et al. | 182/92 |
| 4,388,983 | A | | 6/1983 | Bartels et al. | 182/189 |
| 4,460,290 | A | * | 7/1984 | Mallet | 403/373 |
| 4,754,841 | A | | 7/1988 | Koffski | 182/92 |
| 4,830,142 | A | | 5/1989 | McManus | 182/92 |
| 4,867,421 | A | * | 9/1989 | Vernon | 256/54 |
| 5,033,583 | A | | 7/1991 | Candelaria, Jr. | 182/92 |
| 5,086,873 | A | | 2/1992 | George | 182/92 |
| 5,179,387 | A | * | 1/1993 | Wells | 343/895 |
| D370,268 | S | | 5/1996 | Houry | D25/42 |
| 5,624,092 | A | * | 4/1997 | Kulp et al. | 248/219.3 |
| 5,857,542 | A | | 1/1999 | Mason | 182/92 |
| 6,039,298 | A | * | 3/2000 | Stier | 248/545 |
| 6,116,659 | A | * | 9/2000 | Wagner | 285/373 |
| 6,135,670 | A | * | 10/2000 | Bahnman et al. | 403/373 |
| 6,142,434 | A | * | 11/2000 | Trost et al. | 248/218.4 |
| 6,145,246 | A | * | 11/2000 | Galbraith | 47/46 |

* cited by examiner

*Primary Examiner*—Bruce A. Lev
(74) *Attorney, Agent, or Firm*—William R. Sharp

(57) ABSTRACT

An accessory for a T-post, having a longitudinal axis, comprises: a first bar having a central portion and a longitudinal axis; a second bar having a central portion and a longitudinal axis; and a connecting mechanism for fixedly but removably connecting the first and second bars together in a secure and fixed relationship to the T-post. The central portions of the first and second bars are adapted to be received around the T-post such that the longitudinal axes of the bars are substantially parallel to one another but substantially perpendicular to the longitudinal axis of the T-post.

10 Claims, 3 Drawing Sheets

ACCESSORY FOR A FENCE POST

BACKGROUND OF THE INVENTION

The invention relates to a fence post accessory which is useful as a step (sometimes called a "stile") for climbing over a fence when secured to a fence post.

Individuals, such as farmers, ranchers, inspectors, hunters, surveyors, and game rangers, frequently find it necessary to climb over a fence, most commonly of the type comprising multiple T-posts and barbed wire. Climbing over such a fence, or attempting to crawl under or through the fence, can result in torn clothing, personal injury, and/or damage to the fence.

Permanently installed fence stiles, for use in safely climbing over a fence, can be costly and have the obvious disadvantage of not being portable for use at other locations. Portable fence stiles have been developed with some success. However, prior portable fence stiles have either been undesirably bulky or not useable on all T-posts.

SUMMARY OF THE INVENTION

It is, therefore, an object of the invention to provide an accessory for a fence post which is useable as a stile on virtually any T-post, and which is compact and lightweight for optimum portability.

The above object is realized by an accessory for a fence post having a longitudinal axis, comprising: a first bar having a central portion and a longitudinal axis; a second bar having a central portion and a longitudinal axis; a connecting means for fixedly but removably connecting the first and second bars together in a secure and fixed relationship to the fence post such that the longitudinal axes of the bars are substantially parallel to one another but substantially perpendicular to the longitudinal axis of the fence post, a portion of the fence post being received between the respective central portions of the first and second bars.

According to a preferred embodiment hereafter described, the central portions of the first and second bars are bent so as to define an elongated opening in which a portion of a T-post can be received. The T-post can be of the new light gauge design or the older but still widely used heavier gauge design. Bolts and nuts can be used to connect the first and second bars together in a secure and fixed relationship to either of these types of T-posts. The first and second bars can be less than one foot long and made of aluminum. A fence post accessory of such construction is compact and lightweight so as to be highly portable, yet is still sufficiently large and sturdy to function as an effective fence stile.

DETAILED DESCRIPTION OF THE INVENTION

Figure 1:
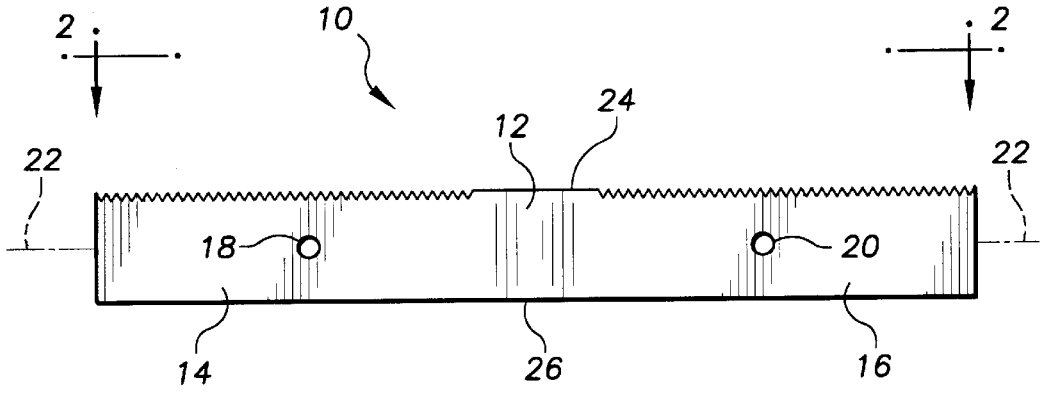
FIGS. 1 and 2 are side and top views of a first bar in accordance with a preferred embodiment of the invention.

Referring to FIG. 1, bar 10 includes a central portion 12 and a pair of elongated side portions 14 and 16 extending from and integral with opposite sides of central portion 12. side portions 14 and 16 have respective holes 18 and 20 therethrough. Bar 10 has a longitudinal axis 22 and opposing, longitudinally extending edges 24 and 26. As shown, edge 24 is serrated along side portions 14 and 16 so as to have a sawtooth texture.

Figure 2:
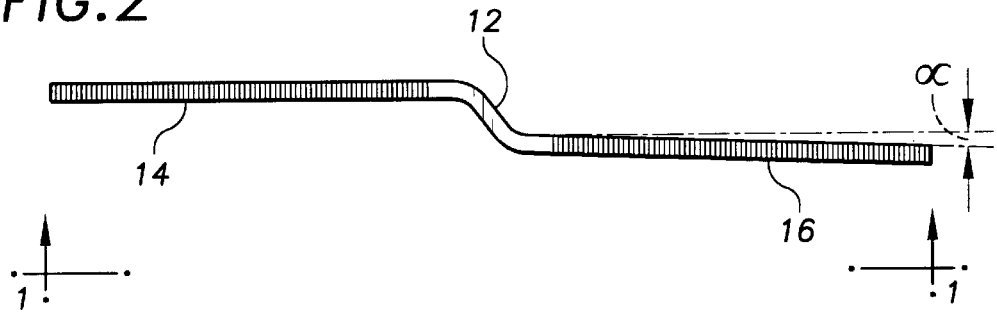

FIG. 2 shows central portion 12 as being bent so as to form the desired illustrated shape. Side portions 14 and 16 are substantially straight. Preferably, side portion 16 extends along a line which defines an angle $\alpha$ with respect to a line parallel to side portion 14. Angle $\alpha$ is preferably about 2–5°.

Figure 3:
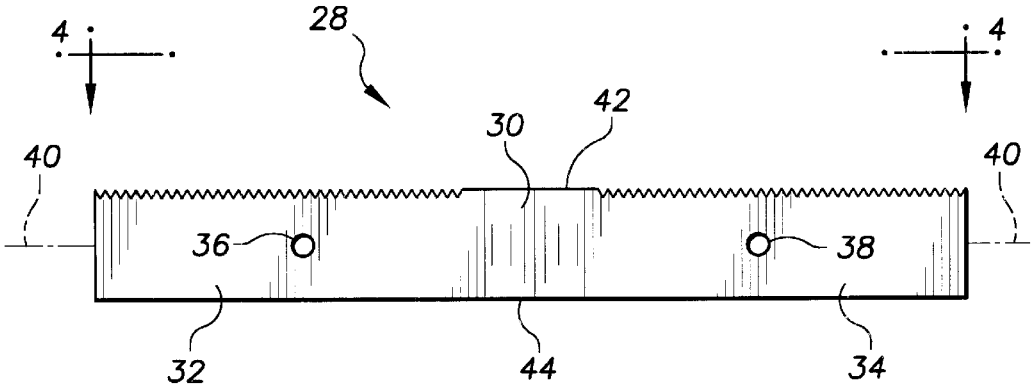
FIGS. 3 and 4 are side and top views of a second bar in accordance with a preferred embodiment of the invention.

Referring to FIG. 3, bar 28 includes a central portion 30 and a pair of elongated side portions 32 and 34 extending from and integral with opposite sides of central portion 30. Side portions 32 and 34 have respective holes 36 and 38 therethrough. Bar 28 has a longitudinal axis 40 and opposing, longitudinally extending edges 42 and 44. As shown, edge 42 is serrated along side portions 32 and 34 so as to have a sawtooth texture.

Figure 4:
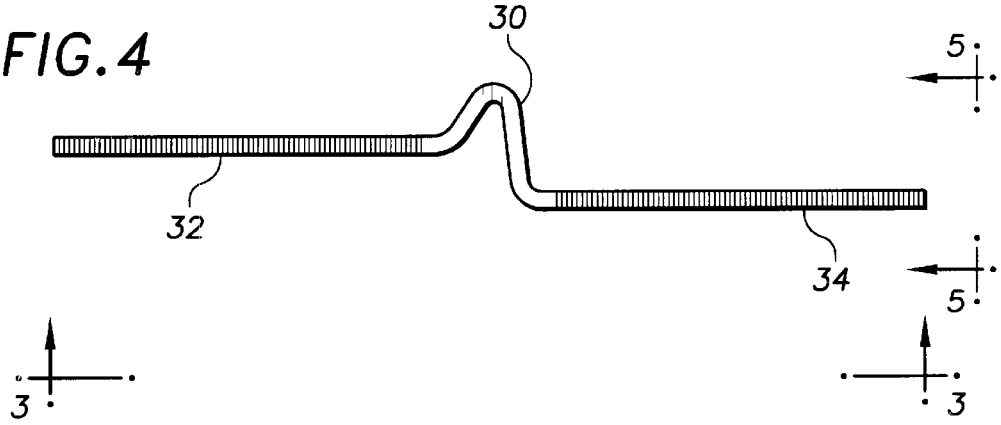
Figure 5:
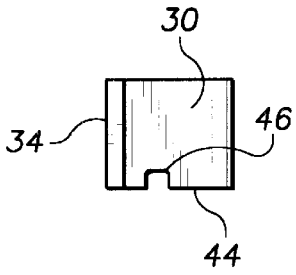
FIG. 5 is an end view of the second bar as viewed along line 5—5 in FIG. 4.

FIG. 4 shows central portion 30 as being bent so as to form the desired illustrated shape. Side portions 32 and 34 are substantially straight. FIG. 5 shows central portion 30 as having a notch 46 along edge 44. AS should be apparent from FIGS. 3 and 4, notch 46 lies in a plane approximately perpendicular to longitudinal axis 40.

Figure 6:
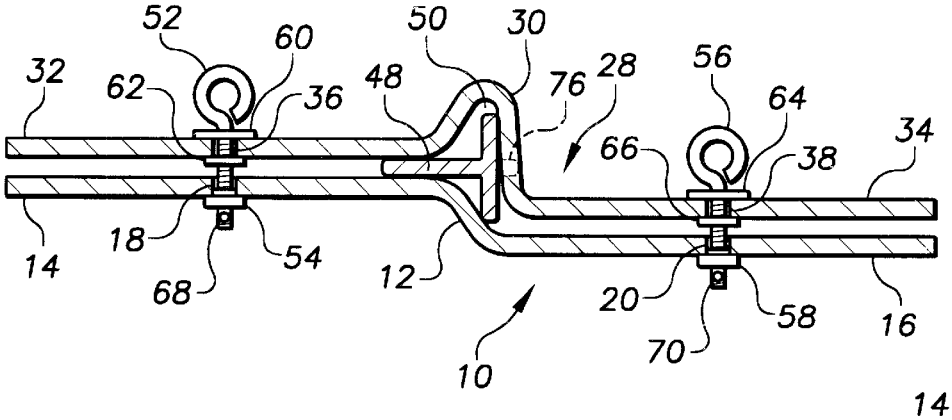
FIG. 6 is a longitudinal cross-sectional view of the two bars connected together as a fence post accessory in a secure and fixed relationship to a fence post, which is shown in transverse cross section.

Referring to FIG. 6, this cross-sectional view illustrates bars 10 and 28 as fixedly but removably connected together in a secure and fixed relationship to fence post 48 such that the longitudinal axes of the bars are substantially parallel to one another. Fence post 48 is a T-post, having a transverse cross-sectional shape of a "T". As shown, a portion of fence post 48 is received between respective central portions 12 and 30 of bars 10 and 28. Central portions 12 and 30 have respective inner surfaces which define an opening 50 therebetween. Opening 50 is elongated so as to extend perpendicularly to the longitudinal axes of bars 10 and 28 between opposing ends of such opening as defined by the inner surfaces of central portions 12 and 30. One leg of fence post 48 extends across opening 50, and the other leg is clamped between side portions 14 and 32 of the bars.

The preferred means for connecting bars 10 and 28 together as shown comprises: a bolt 52 for being received through aligned holes 18 and 36; a nut 54, preferably affixed to side portion 14, for threadedly receiving bolt 52 therethrough; a bolt 56 for being received through aligned holes 20 and 38; and a nut 58, preferably affixed to side portion 16, for threadedly receiving bolt 56 therethrough. Bolt 52 preferably has associated therewith a standard washer 60 abutting the outer surface of side portion 32 and a locking washer 62 abutting the inner surface of such side portion. Locking washer 62 functions to retain bolt 52 in the position shown relative to side portion 32 whenever bolt 52 is turned appropriately to partially or completely back it out of its threaded engagement with nut 54. Similarly, bolt 56 has associated therewith a standard washer 64 abutting the outer surface of side portion 34 and a locking washer 66 abutting the inner surface of such side portion.

Bolts 52 and 56 are preferably eyebolts, as shown. The looped heads of such eyebolts can be easily grasped by a user in tightening or loosening their threaded engagement with corresponding nuts. A user could also insert a screwdriver or other elongated object through the looped head of an eyebolt to tighten or loosen as desired. Nuts 54 and 58 are most preferably PEM self-clinching nuts. PEM is a registered trademark of Penn Engineering and Manufacturing Corp. This type of nut has a clinching ring which can be securely pressed into the corresponding hole in either side portion 14 or 16.

Finally with regard to FIG. 6, it should be noted that bolt 56 is preferably tightened sufficiently with respect to nut 58 so that side portion 16 is approximately parallel to side portion 14. AS previously mentioned with reference to FIG. 2, side portion 16 defines a small angle with respect to side portion 14 when bar 10 is in its relaxed state. Accordingly, as bars 10 and 28 are connected together in FIG. 6, there is a tension on both sides of the bars to assist in preventing rotation of bolts 52 and 56 with respect to nuts 54 and 58, respectively, to thereby effectively lock the bolts in their desired positions relative to the corresponding nuts. Transversely extending holes 68 and 70 adjacent to the threaded ends of bolts 52 and 56 can receive cotter pins (not shown) therethrough to further ensure against the possibility of such bolts backing out from their desired positions with respect to corresponding nuts 54 and 58. cotter pins would be used in this manner primarily when bars 10 and 28 are secured to fence post 48 for an extended period of time.

Figure 7:
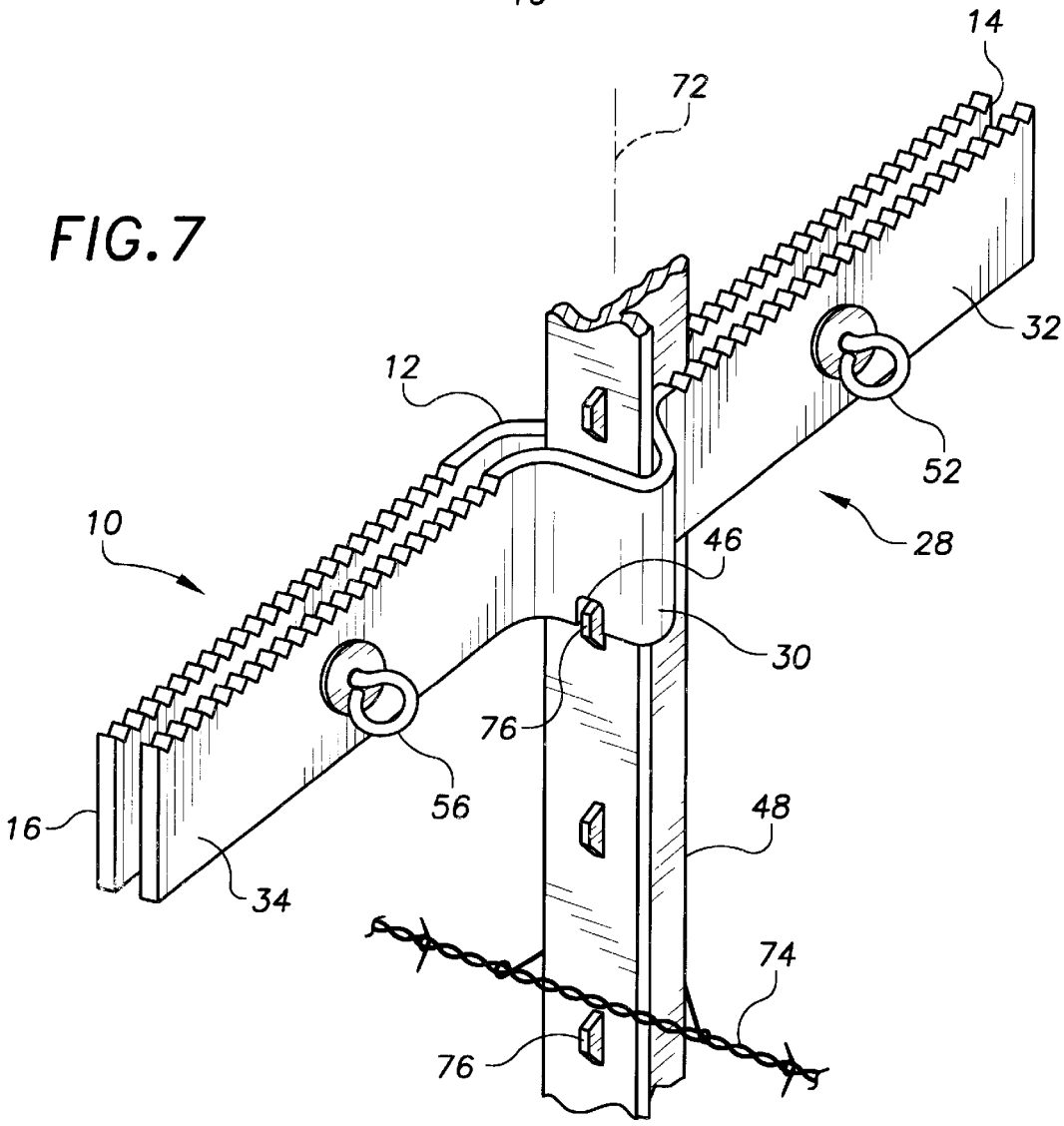
FIG. 7 is a perspective view of the fence post accessory of FIG. 6, for use as a fence stile, as secured to a fence post of a barbed wire fence.

Referring to FIG. 7, this perspective view shows bars 10 and 28 connected together and secured to fence post 48 of a barbed wire fence such that their longitudinal axes are substantially perpendicular to longitudinal axis 72 of the fence post. Only a portion of fence post 48 is shown. A barbed wire 74 is shown conventionally secured to fence post 48 immediately adjacent to one of a plurality of longitudinally spaced knobs 76, which are integral with one leg of the fence post. A knob 76 as adjacent to a wire functions as a wire stop. Notch 46 fits over another knob 76 (which is indicated by broken lines in FIG. 6) so as to prevent the connected bars 10 and 28 from sliding vertically down fence post 48 when downward pressure is applied to the bars. Notch 46 is a particularly preferred feature since it enhances the horizontal stability of bars 10 and 28 when engaged over a knob 76. An individual can climb over the fence by placing one foot upon side portions of bars 10 and 28 on one side of the fence, and swinging the other foot over the top wire (not shown) and onto those side portions on the other side of the fence. The upper edges of bars 10 and 28, as serrated along the side portions thereof, enhances traction when an individual steps upon such edges. The looped heads of bolts 52 and 56 are also shown in FIG. 7, but the associated nuts are not visible this FIGURE.

Bars 10 and 28 can be easily and quickly removed from fence post 48 by, for example, loosening bolt 56 only partially, removing bolt 52 completely from threaded engagement with its corresponding nut while pivoting side portion 14 horizontally away from side portion 32, pivoting side portion 14 upwardly to remove central portion 12 out of engagement with fence post 48, lifting bar 28 upwardly to disengage notch 46 from knob 76, and then moving bar 28 horizontally away from fence post 48 to remove central portion 30 out of engagement with fence post 48. Bars 10 and 28 can be secured onto fence post 48 (or another fence post at another location) by loosening bolt 56 only partially, removing bolt 52 completely from threaded engagement with its corresponding nut (assuming it is so threadedly engaged) while pivoting side portion 14 horizontally away from side portion 32, pivoting side portion 14 upwardly, moving bar 28 horizontally so as to engage central portion 30 with fence post 48 above a knob 76, lowering bar 28 so that notch 46 engages knob 76, pivoting side portion 14 downwardly so that central portion 12 engages fence post 48, threadedly engaging bolt 52 with its corresponding nut and tightening bolt 52 and also bolt 56 so as to fixedly secure bars 10 and 28 to fence post in preparation for climbing over the fence. Of course, the above described procedures could be performed equally well by loosening bolt 52 partially and removing bolt 56 completely from threaded engagement with its corresponding nut, in which case side portion 16 would be pivoted in a manner similar to that previously described with respect to side portion 14.

Bars 10 and 28 are preferably comprised of aluminum, which is desirably light in weight but sufficiently strong to support an individual. The bent shapes of central portions 12 and 30 can be achieved by bending straight bars using suitable machinery and templates. Alternatively, bars 10 and 28 could be cast using suitable molds. Bolts 52 and 56, and associated nuts 54 and 58, are preferably comprised of steel. The washers could also be made of steel.

Some preferred dimensions for bars 10 and 28 are provided for the sake of illustration, but should not be construed to limit the invention in any manner: length of bars 10 and 28—about 11.5 inches; length of central portions 12 and 30—about 1.7 inches; width of bars 10 and 28—about 1.5 inches; width of notch 46—about 13/32 inch; depth of notch 46—about 7/32 inch. The dimensions of the bars are sufficiently large for effective use as a fence stile, but provide the compactness for highly desirable portability.

Thus, there is provided by the present invention a fence post accessory useable as fence stile, which is not only very portable for ease of carrying from one location to another, but which can also be secured to virtually any fence post of the T-post design by virtue of the novel combination of the separate bars and suitable means for removably connecting them together in a fixed relationship to the fence post. In such regard, the preferred dimensions given above for the notch will fit the knobs of any T-post.

Obviously, many modifications and variations of the present invention are possible in light of the above teachings. For example, although it is preferred that the central portion of one bar has a notch along an edge thereof for fitting over the knob of a fence post, insofar as such feature enhances the horizontal stability of the bars as secured to the fence post, the aforementioned edge without a notch would engage the upper surface of the knob to effectively prevent the connected bars from sliding vertically down the fence post. In addition, although the fence post accessory is described above for use as a fence stile, such accessory as secured to a fence post could be applied to any other useful purpose. By way of example, sheets of plywood or other material could be connected to the accessory with additional suitable hardware in the construction of temporary building structures, in which case the fence post and associated accessory would function as a support mechanism. It is, therefore, to be understood that within the scope of the appended claims, the invention can be practiced otherwise than as specifically described.

That which is claimed is:

1. A combination of a T-post and a stile, the combination comprising:

first and second bars a stile including of which each bar has a longitudinal axis, a central portion, and a pair of elongated and substantially straight side portions extending from and integral with opposite sides of the central portion, wherein the central portion of each bar is bent such that its side portions are transversely offset from one another so as to lie in separate planes; and a connecting means for fixedly but removably connecting the first and second bars together in a secure and fixed relationship to the T-post; wherein the central portions of the first and second bars are adapted to be received around the T-post such that the longitudinal axes of the bars are substantially parallel to one another but substantially perpendicular to the longitudinal axis of the T-post.

2. The combination as recited in claim 1 wherein the central portions of the first and second bars have respective inner surfaces which, when such bars are connected together, define a cavity being shaped to securely receive the T-post and also being open at the opposing edges along the central portions.

3. The combination as recited in claim 2 wherein said cavity is elongated so as to extend substantially perpendicularly to the longitudinal axes of the first and second bars between opposing ends of such cavity as defined by the inner surfaces of the central portions.

4. The combination as recited in claim 3 wherein each of the first and second bars has opposing, longitudinally extending edges, and wherein the central portion of one bar has a notch along one edge thereof.

5. The combination as recited in claim 4 wherein the notch lies in a plane approximately perpendicular to the longitudinal axis of said one bar.

6. The combination as recited in claim 5 wherein the other edge of said one bar is serrated along the side portions thereof, and wherein one edge of the other bar is also serrated along the side portions thereof.

7. The combination as recited in claim 6 wherein each side portion of each bar has a hole therethrough.

8. The combination as recited in claim 7 wherein said connecting means comprises: a first bolt for being received through aligned holes of side portions of the first and second bars on one side of the central portions; a first nut for threadedly receiving the first bolt therethrough; a second bolt for being received through aligned holes of side portions of the first and second bars on the other side of the central portions; and a second nut for threadedly receiving the second bolt therethrough.

9. The combination as recited in claim 8 wherein the first and second bolts are eyebolts.

10. The combination as recited in claim 9 wherein the first and second bars are comprised of aluminum, and the first and second bolts and associated first and second nuts are comprised of steel.

* * * * *

UNITED STATES PATENT AND TRADEMARK OFFICE

CERTIFICATE OF CORRECTION

PATENT NO. : 6,394,228 B1 
DATED : May 28, 2002
INVENTOR(S) : Kendall M. Stephens and Norman D. Gideon It is certified that error appears in the above-identified patent and that said Letters Patent is hereby corrected as shown below:

Column 4,
Line 56, after "comprising:" -- a T-post having a T-shaped transverse cross section and a longitudinal axis; -- should be inserted.

Line 57, before "first and second bars" -- a stile including -- should be inserted, and "a stile including" should be deleted after "first and second bars".

Line 66, after "T-post" ";" should be -- , --.

Signed and Sealed this

First Day of October, 2002

*Attest:*

*Attesting Officer*

JAMES E. ROGAN
*Director of the United States Patent and Trademark Office*